United States Patent [19]

Slocumb

[11] Patent Number: 4,741,442

[45] Date of Patent: May 3, 1988

[54] PLASTIC NETTING FOR PALLETIZED LOADS WITH EQUAL TENSION IN ALL STRANDS

[75] Inventor: Robert C. Slocumb, New Brighton, Minn.

[73] Assignee: Leucadia, Inc., New York, N.Y.

[21] Appl. No.: 926,967

[22] Filed: Nov. 4, 1986

[51] Int. Cl.[4] ..... B65D 19/00

[52] U.S. Cl. ..... 206/597; 53/461; 108/55.1; 428/255

[58] Field of Search ..... 206/597, 83.5, 386; 428/108, 247, 255; 53/446, 461; 108/55.1, 55.5

[56] References Cited

U.S. PATENT DOCUMENTS

| | | | |
|---|---|---|---|
| Re. 31,191 | 3/1983 | Connolly . | |
| 2,919,467 | 1/1980 | Mercer . | |
| 3,495,375 | 2/1970 | Burhop et al. . | |
| 3,647,061 | 3/1972 | Kaupin | 206/83.5 |
| 3,867,806 | 2/1975 | Lancaster, III et al. . | |
| 3,945,493 | 3/1976 | Cardinal . | |
| 3,952,127 | 4/1976 | Orr | 428/255 |
| 4,059,713 | 11/1977 | Mercer | 428/255 |
| 4,067,174 | 1/1978 | Goldstein . | |
| 4,136,501 | 6/1980 | Connolly . | |
| 4,201,814 | 5/1980 | Gilbert et al. | 428/255 |
| 4,206,846 | 6/1980 | Connolly . | |
| 4,208,457 | 6/1980 | Kelly . | |
| 4,241,123 | 12/1980 | Shih | 428/255 |
| 4,270,657 | 6/1981 | Bayon | 206/597 |
| 4,332,326 | 6/1982 | Kelly . | |
| 4,402,409 | 9/1983 | Slocumb . | |
| 4,460,086 | 7/1984 | Davis | 206/389 |

*Primary Examiner*—Stephen Marcus
*Assistant Examiner*—Bryon Gehman
*Attorney, Agent, or Firm*—Vidas & Arrett

[57] ABSTRACT

Diamond configuration plastic netting for palletized loads. A pallet load wrapped with at least one continuous length of plastic netting having one set of spaced substantially parallel strands extending at an angle of less than 90 degrees upwardly with respect to the longitudinal direction and a second set of spaced substantially parallel strands overlying the first set and extending at an angle of less than 90 degrees downwardly with respect to the longitudinal direction of the netting length. The strands are joined at the intersections thereof and provide a diamond-like configuration to the netting, the netting being so positioned relative to the load such that all the netting strands are subjected to approximately equal tension.

6 Claims, 1 Drawing Sheet

PLASTIC NETTING FOR PALLETIZED LOADS WITH EQUAL TENSION IN ALL STRANDS

BACKGROUND OF THE INVENTION

The present invention relates to plastic netting and sepcifically to a particular form of plastic netting for use in wrapping palletized loads with improved results.

The wrapping of palletized loads in order to unitize the load is well known. It is taught, for example, in U.S. Pat. Nos. 3,495,375; 3,867,806; and 4,067,174. These patents disclose wrapping palletized loads with plastic films.

The use of plastic nets for wrapping palletized loads is also known in the art. The use of netting for this purpose is disclosed, for example in U.S. Pat. Nos. 3,945,493 and 4,136,501 (Re. 31,191). The former patent teaches a process in which the net is heat shrunk about the load while the latter patent teaches a process in which the net is stretched as it is being applied under tension. U.S. Pat. No. 4,206,846 relates to generally similar subject matter for netting use in pallet wrapping.

U.S. Pat. Nos. 4,208,457 and 4,332,326 disclose the use of netting in which the strands are molecularly oriented before the net is applied to the load.

U.S. Pat. No. 4,402, 409 is also directed to improved netting for pallet wrap in which the netting has a relatively low degree of permanent stretch and a relatively high degree of elastic stretch.

All of the plastic netting used heretofore and referred to above in pallet wrapping has been of the so-called "square mesh" configuration or "bias configuration". U.S. Pat. No. 4,332,326 and U.S. Pat. No. 4,402,409 make reference to "diamond mesh" configuration netting but instruct that it be converted to a "square mesh net" before being used for pallet wrapping.

The "square mesh" and the "bias" nets of the prior art consist of longitudinal and transverse strands arranged at substantially right angles to each other. When such nets are used in pallet wrapping, the longitudinal strands, i.e., the strands extending in the direction of wrap (typically the machine direction MD) are required to sustain most of the tension due to the wrapping and the load whereas the transverse strands (transverse direction) provide little or no support to the load. Despite the fact that a load might be tightly wrapped by means of tensioning the longitudinal strands, the relatively loose transverse strands permit the load to shift to a degree which can be unacceptable.

All of the patents referred to herein are incorporated by reference. Reference to these patents will disclose the wrapping methods used in pallet wrapping.

SUMMARY OF THE INVENTION

The present invention provides a net of the "diamond mesh" configuration for use in palletized loads in which all of the net strands are equally subjected to tension in pallet wrapping and in holding the load on the pallet. When net of this configuration is pulled in the direction of wrap (typically, the machine direction MD), both sets of strands come under tension. Such a configuration permits the use of higher wrapping forces because both sets of strands share the wrapping force. Thus a relatively lighter net can be used to wrap a load to a given tension. Also, a lighter net can provide better load consolidation by not allowing load shifting to initiate.

DESCRIPTION OF THE PREFERRED EMBODIMENT

Figure 1:
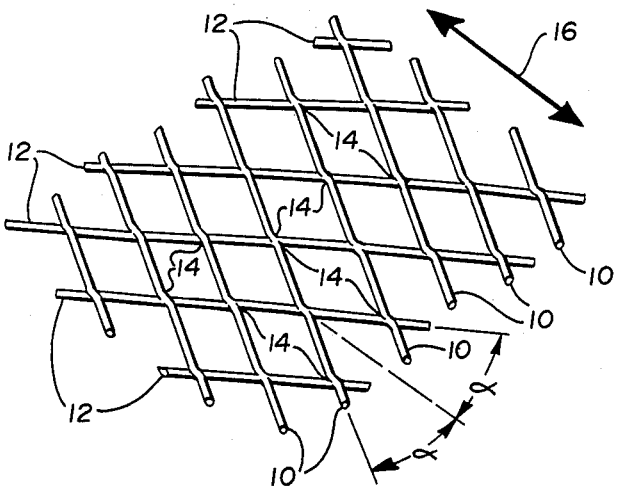
FIG. 1 is a perspective detail of a fragment of biplanar diamond mesh net for practicing the invention.

FIG. 1 shows a fragment of continuous net sheet of biplanar diamond mesh configuration in which one set of strands 10 overlies a second set of strands 12. This net in biplanar form is the preferred diamond net of the invention. The strands are composed of thermoplastic material which is extruded in accordance with known procedures to form the net as shown in which strands 10 and 12 are connected at joints 14. Strands 10 and 12 extend generally in the longitudinal direction of the net sheeting as indicated by arrow 16 in the Figure.

As can be seen from the Figure, each of the sets of parallel strands 10 and 12 extend generally in the longitudinal direction, i.e., the direction of wrap at an angle $\alpha$ of less than 90 degrees upwardly or downwardly with respect to the longitudinal direction of the netting length to thereby provide two sets of strands which share tension applied to the netting in the longitudinal direction. Typically, this direction is also the machine direction (MD).

The strands may be oriented, if desired. Also, the strands need not be of the biplanar arrangement shown in the Figure but may be uniplanar of the type produced in accordance with U.S. Pat. No. 2,919,467. The biplanar configuration also described in 2,919,467 is most preferred.

If oriented net is desired, it is preferred that the strands be oriented within the range of 4:1–20:1, 8:1–10:1 being most preferred. Typically, orientation will be accomplished on staged drafter rolls in the known manner. In the case of unoriented net, a strand count of 1–30 strands/inch is preferred, 2–10 being most preferred. In the case of oriented net, it is best characterized as a derivative arrived at by dividing the non-oriented strand count by the orientation ratio.

Any of a number of thermoplastic materials commonly used in manufacturing extruded netting may be utilized for the pallet wrap netting of this invention, however, polypropylene is particularly preferred. Blends of polypropylene and linear low density polyethylene are also preferred compositions. Still others include propylene, linear low density polyethylene, high density polyethylene, medium density, polyethylene, polybutylene and blends thereof.

Figure 2:
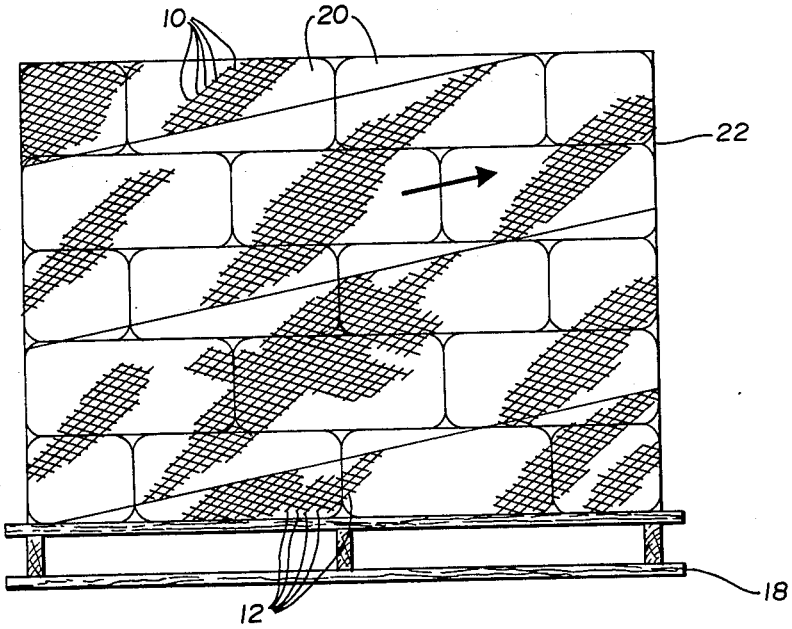
FIG. 2 shows a typical palletized load according to the present invention.

FIG. 2 shows a pallet 18 having a plurality of containers 20 thereon. Wrapped about the pallet and containers to form a palletized load is a net 22 made in accordance with the present invention as described above, i.e., the biplanar diamond configuration. The strands 10 and 12 all extend generally in the direction of wrap (arrow) in accordance with the invention. A pallet wrapped in the manner using diamond net exhibits improved stability of the load.

It will be understood that the claims are intended to cover all changes and modifications of the preferred embodiments of the invention herein chosen for the purpose of illustration. Such changes and modifications not constituting departures from the spirit and scope of the invention. It will also be understood that the pertinent portions of all patents mentioned are incorporated herein by reference.

What is claimed is:

1. A pallet load wrapped with at least one continuous length of plastic netting, the netting having one set of spaced substantially parallel strands extending at an angle of less than 90 degrees upwardly with respect to the longitudinal direction and a second set of spaced substantially parallel strands overlying the first set and extending at an angle of less than 90 degrees downwardly with respect to the longitudinal direction of the netting length, the strands being joined at the intersections thereof and providing a diamond-like configuration to the netting, the netting being so positioned relative to the load such that all the netting strands are subjected to approximately equal tension.

2. The pallet load of claim 1 in which the plastic of the netting is a thermoplastic.

3. The pallet load of claim 2 in which the netting is oriented.

4. The method of stabilizing a load on a pallet comprising wrapping at least one continuous length of plastic netting around the load, the netting having one set of spaced substantially parallel strands extending at an angle of less than 90 degrees upwardly with respect to the longitudinal direction of the netting length and a second set of spaced substantially parallel strands overlying the first set and extending at an angle of less than 90 degrees downwardly with respect to the longitudinal direction of the netting length, the strands being joined at the intersections thereof and providing a diamond-like configuration to the netting, the netting being so positioned relative to the load such that all the strands are subjected to approximately equal tension.

5. The pallet load of claim 4 in which the plastic of the netting is a thermoplastic.

6. The pallet load of claim 5 in which the netting is oriented.

* * * * *

UNITED STATES PATENT AND TRADEMARK OFFICE

CERTIFICATE OF CORRECTION

PATENT NO. : 4,741,442

DATED : May 3, 1988

INVENTOR(S) : Robert C. Slocomb

It is certified that error appears in the above-identified patent and that said Letters Patent is hereby corrected as shown below:

Column 1, line 7 "sepcifically" should read --specifically --.
Column 2, line 60 "the" (second Occurrence) should read --this --.

Signed and Sealed this

Eleventh Day of October, 1988

*Attest:*

DONALD J. QUIGG

*Attesting Officer*

*Commissioner of Patents and Trademarks*